US010472706B2

(12) United States Patent
Novotny

(10) Patent No.: US 10,472,706 B2
(45) Date of Patent: Nov. 12, 2019

(54) HIGH STRENGTH, HIGH TOUGHNESS STEEL ALLOY

(71) Applicant: CRS HOLDINGS, INC., Wilmington, DE (US)

(72) Inventor: Paul M. Novotny, Mohnton, PA (US)

(73) Assignee: CRS HOLDINGS, INC., Wilmington, DE (US)

( * ) Notice: Subject to any disclaimer, the term of this patent is extended or adjusted under 35 U.S.C. 154(b) by 0 days.

(21) Appl. No.: 16/396,950

(22) Filed: Apr. 29, 2019

(65) Prior Publication Data

US 2019/0249281 A1 Aug. 15, 2019

Related U.S. Application Data

(63) Continuation of application No. 15/463,445, filed on Mar. 20, 2017, now abandoned, which is a continuation of application No. 13/646,988, filed on Oct. 8, 2012, now abandoned, which is a continuation of application No. 12/488,112, filed on Jun. 19, 2009, now abandoned.

(60) Provisional application No. 61/083,249, filed on Jul. 24, 2008, provisional application No. 61/172,098, filed on Apr. 23, 2009.

(51) Int. Cl.

| | |
|---|---|
| ***C22C 38/46*** | (2006.01) |
| ***C22C 38/02*** | (2006.01) |
| ***C22C 38/04*** | (2006.01) |
| ***C22C 38/34*** | (2006.01) |
| ***C22C 38/42*** | (2006.01) |
| ***C22C 38/44*** | (2006.01) |
| ***C21D 6/00*** | (2006.01) |
| *C21D 1/32* | (2006.01) |

(52) U.S. Cl.

CPC ..... *C22C 38/46* (2013.01); *C21D 6/004* (2013.01); *C22C 38/02* (2013.01); *C22C 38/04* (2013.01); *C22C 38/34* (2013.01); *C22C 38/42* (2013.01); *C22C 38/44* (2013.01); *C21D 1/32* (2013.01)

(58) Field of Classification Search

CPC ..... C21D 1/32; C21D 6/004; C22C 38/02; C22C 38/04; C22C 38/34; C22C 38/42; C22C 38/44; C22C 38/46

USPC ..... 148/320, 332–337, 622–624; 420/89–93, 420/104–119, 122–124

See application file for complete search history.

(56) References Cited

U.S. PATENT DOCUMENTS 4,729,872 A * 3/1988 Kishida ..... C22C 38/22 420/105

5,458,703 A * 10/1995 Nakai ..... C21D 1/18 148/503

* cited by examiner

*Primary Examiner* — Brian D Walck

(74) *Attorney, Agent, or Firm* — Dann, Dorfman, Herrell and Skillman, P.C.

(57) ABSTRACT

A high strength, high toughness steel alloy is disclosed. The alloy has the following broad weight percent composition.

| Element | Broad |
|---|---|
| C | 0.35-0.55 |
| Mn | 0.6-1.2 |
| Si | 0.9-2.5 |
| P | 0.01 max. |
| S | 0.001 max. |
| Cr | 0.75-2.0 |
| Ni | 3.5-7.0 |
| Mo + ½ W | 0.4-1.3 |
| Cu | 0.5-0.6 |
| Co | 0.01 max. |
| V + (5/9) × Nb | 0.2-1.0 |
| Fe | Balance |

Included in the balance are the usual impurities found in commercial grades of steel alloys produced for similar use and properties. Also disclosed is a hardened and tempered article that has very high strength and fracture toughness. The article is formed from the alloy having the broad weight percent composition set forth above. The alloy article according to this aspect of the invention is further characterized by being tempered at a temperature of about 500° F. to 600° F.

10 Claims, No Drawings

HIGH STRENGTH, HIGH TOUGHNESS STEEL ALLOY

CROSS REFERENCE TO RELATED APPLICATIONS

This application is a continuation of application Ser. No. 15/463,445, filed Mar. 20, 2017, which is a continuation of application Ser. No. 13/646,988, filed Oct. 8, 2012, which is a continuation of application Ser. No. 12/488,112, filed Jun. 19, 2009, which claims priority from U.S. Provisional Application No. 61/083,249, filed Jul. 24, 2008 and U.S. Provisional Application No. 61/172,098, filed Apr. 23, 2009, the entireties of which are incorporated herein by reference.

BACKGROUND OF THE INVENTION

Field of the Invention

This invention relates to high strength, high toughness steel alloys, and in particular, to such an alloy that can be tempered at a significantly higher temperature without significant loss of tensile strength. The invention also relates to a high strength, high toughness, tempered steel article.

Description of the Related Art

Age-hardenable martensitic steels that provide a combination of very high strength and fracture toughness are known. Among the known steels are those described in U.S. Pat. Nos. 4,076,525 and 5,087,415. The former is known as AF1410 alloy and the latter is sold under the registered trademark AERMET. The combination of very high strength and toughness provided by those alloys is a result of their compositions which include significant amounts of nickel, cobalt, and molybdenum, elements that are typically among the most expensive alloying elements available. Consequently, those steels are sold at a significant premium compared to other alloys that do not contain such elements.

More recently, a steel alloy has been developed that provides a combination of high strength and high toughness without the need for alloying additions such as cobalt and molybdenum. One such steel is described in U.S. Pat. No. 7,067,019. The steel described in that patent is an air hardening CuNiCr steel that excludes cobalt and molybdenum. In testing, the alloy described in the '019 patent has been shown to provide a tensile strength of about 280 ksi together with a fracture toughness of about 90 ksi √in. The alloy is hardened and tempered to achieve that combination of strength and toughness. The tempering temperature is limited to not more than about 400° F. in order to avoid softening of the alloy and a corresponding loss of strength.

The alloy described in the '019 patent is not a stainless steel and therefore, it must be plated to resist corrosion. Material specifications for aerospace applications of the alloy require that the alloy be heated at 375° F. for at least 23 hours after being plated in order to remove hydrogen adsorbed during the plating process. Hydrogen must be removed because it leads to embrittlement of the alloy and adversely affects the toughness provided by the alloy. Because this alloy is tempered at 400° F., the 23 hour 375° F. post-plating heat treatment results in over-tempering of parts made from the alloy such that a tensile strength of at least 280 ksi cannot be provided. It would be desirable to have a CuNiCr alloy that can be hardened and tempered to provide a tensile strength of at least 280 ksi and a fracture toughness of about 90 ksi √in, and maintain that combination of strength and toughness when heated at about 375° F. for at least 23 hours, subsequent to being hardened and tempered.

SUMMARY OF THE INVENTION

The disadvantages of the known alloys as described above are resolved to a large degree by an alloy according to the present invention. In accordance with one aspect of the present invention, there is provided a high strength, high toughness steel alloy that has the following broad and preferred weight percent compositions.

| Element | Broad | Preferred |
|---|---|---|
| C | 0.35-0.55 | 0.37-0.50 |
| Mn | 0.6-1.2 | 0.7-0.9 |
| Si | 0.9-2.5 | 1.3-2.1 |
| P | 0.01 max. | 0.005 max. |
| S | 0.001 max. | 0.0005 max. |
| Cr | 0.75-2.0 | 1.2-1.5 |
| Ni | 3.5-7.0 | 3.7-4.5 |
| Mo + ½ W | 0.4-1.3 | 0.5-1.1 |
| Cu | 0.5-0.6 | 0.5-0.6 |
| Co | 0.01 max. | 0.01 max. |
| V + (5/9) × Nb | 0.2-1.0 | 0.2-1.0 |
| Fe | Balance | Balance |

Included in the balance are the usual impurities found in commercial grades of steel alloys produced for similar use and properties. Within the foregoing weight percent ranges, silicon, copper, and vanadium are balanced such that $$2 \leq (\%\ Si + \%\ Cu)/(\%\ V + (5/9) \times \%\ Nb) \leq 14.$$

The foregoing tabulation is provided as a convenient summary and is not intended to restrict the lower and upper values of the ranges of the individual elements for use in combination with each other, or to restrict the ranges of the elements for use solely in combination with each other. Thus, one or more of the ranges can be used with one or more of the other ranges for the remaining elements. In addition, a minimum or maximum for an element of a broad or preferred composition can be used with the minimum or maximum for the same element in another preferred or intermediate composition. Moreover, the alloy according to the present invention may comprise, consist essentially of, or consist of the constituent elements described above and throughout this application. Here and throughout this specification the term "percent" or the symbol "%" means percent by weight or mass percent, unless otherwise specified.

In accordance with another aspect of the present invention, there is provided a hardened and tempered steel alloy article that has very high strength and fracture toughness. The article is formed from an alloy having the broad or preferred weight percent composition set forth above. The alloy article according to this aspect of the invention is further characterized by being tempered at a temperature of about 500° F. to 600° F.

DETAILED DESCRIPTION

The alloy according to the present invention contains at least about 0.35% and preferably at least about 0.37% carbon. Carbon contributes to the high strength and hardness capability provided by the alloy. Carbon is also beneficial to the temper resistance of this alloy. Too much carbon adversely affects the toughness provided by the alloy. Therefore, carbon is restricted to not more than about 0.55%, better yet to not more than about 0.50%, and preferably to not more than about 0.45%.

At least about 0.6%, better yet at least about 0.7%, and preferably at least about 0.8% manganese is present in this alloy primarily to deoxidize the alloy. It has been found that manganese also benefits the high strength provided by the alloy. If too much manganese is present, then an undesirable amount of retained austenite may result during hardening and quenching such that the high strength provided by the alloy is adversely affected. Therefore, the alloy contains not more than about 1.2% and preferably not more than about 0.9% manganese.

Silicon benefits the hardenability and temper resistance of this alloy. Therefore, the alloy contains at least about 0.9% silicon and preferably, at least about 1.3% silicon. Too much silicon adversely affects the hardness, strength, and ductility of the alloy. In order to avoid such adverse effects silicon is restricted to not more than about 2.5% and preferably to not more than about 2.1% in this alloy.

The alloy contains at least about 0.75% chromium because chromium contributes to the good hardenability, high strength, and temper resistance provided by the alloy. Preferably, the alloy contains at least about 1.0%, and better yet at least about 1.2% chromium. More than about 2% chromium in the alloy adversely affects the impact toughness and ductility provided by the alloy. Preferably, chromium is restricted to not more than about 1.5% in this alloy and better yet to not more than about 1.35%.

Nickel is beneficial to the good toughness provided by the alloy according to this invention. Therefore, the alloy contains at least about 3.5% nickel and preferably at least about 3.7% nickel. The benefit provided by larger amounts of nickel adversely affects the cost of the alloy without providing a significant advantage. In order to limit the upside cost of the alloy, nickel is restricted to not more than about 7% and preferably to not more than about 4.5% in the alloy.

Molybdenum is a carbide former that is beneficial to the temper resistance provided by this alloy. The presence of molybdenum boosts the tempering temperature of the alloy such that a secondary hardening effect is achieved at about 500° F. Molybdenum also contributes to the strength and fracture toughness provided by the alloy. The benefits provided by molybdenum are realized when the alloy contains at least about 0.4% molybdenum and preferably at least about 0.5% molybdenum Like nickel, molybdenum does not provide an increasing advantage in properties relative to the significant cost increase of adding larger amounts of molybdenum. For that reason, the alloy contains not more than about 1.3% molybdenum and preferably not more than about 1.1% molybdenum. Tungsten may be substituted for some or all of the molybdenum in this alloy. When present, tungsten is substituted for molybdenum on a 2:1 basis. When the alloy contains less than about 0.01% molybdenum, about 0.8 to about 2.6 percent, preferably about 1.0 to 2.2% tungsten is included to benefit the temper resistance, strength, and toughness provided by the alloy.

This alloy preferably contains at least about 0.5% copper which contributes to the hardenability and impact toughness of the alloy. Too much copper can result in precipitation of an undesirable amount of free copper in the alloy matrix and adversely affect the fracture toughness of the alloy. Therefore, not more than about 0.6% copper is present in this alloy.

Vanadium contributes to the high strength and good hardenability provided by this alloy. Vanadium is also a carbide former and promotes the formation of carbides that help provide grain refinement in the alloy and that benefit the temper resistance and secondary hardening of the alloy. For those reasons, the alloy preferably contains at least about 0.25% vanadium. Too much vanadium adversely affects the strength of the alloy because of the formation of larger amounts of carbides in the alloy which depletes carbon from the alloy matrix material. Accordingly, the alloy contains not more than about 0.35% vanadium. Niobium can be substituted for some or all of the vanadium in this alloy because like vanadium, niobium combines with carbon to form $M_4C_3$ carbides that benefit the temper resistance and hardenability of the alloy. When present, niobium is substituted for vanadium on 1.8:1 basis. When vanadium is restricted to not more than about 0.01%, the alloy contains about 0.2 to about 1.0% niobium.

This alloy may also contain a small amount of calcium up to about 0.005% retained from additions during melting of the alloy to help remove sulfur and thereby benefit the fracture toughness provided by the alloy.

Silicon, copper, vanadium, and when present, niobium are preferably balanced within their above-described weight percent ranges to benefit the novel combination of strength and toughness that characterize this alloy. More specifically, the ratio (% Si+% Cu)/(% V+(5/9)×% Nb) is preferably about 2 to 14, and better yet, about 6 to 12. It is believed that when the amounts of silicon, copper, and vanadium present in the alloy are balanced in accordance with the ratio, the grain boundaries of the alloy are strengthened by preventing brittle phases and tramp elements from forming on the grain boundaries.

The balance of the alloy is essentially iron and the usual impurities found in commercial grades of similar alloys and steels. In this regard, the alloy preferably contains not more than about 0.01%, better yet, not more than about 0.005% phosphorus and not more than about 0.001%, better yet not more than about 0.0005% sulfur. The alloy preferably contains not more than about 0.01% cobalt. Titanium may be present at a residual level from deoxidation additions and is preferably restricted to not more than about 0.01%.

Within the foregoing weight percent ranges, the elements can be balanced to provide different levels of tensile strength. Thus, for example, an alloy composition containing about 0.38% C, 0.84% Mn, 1.51% Si, 1.25% Cr, 3.78% Ni, 0.50% Mo, 0.55% Cu, 0.29% V, balance essentially Fe, has been found to provide a tensile strength in excess of 290 ksi in combination with a $K_k$ fracture toughness greater than 80 ksi √in, after being tempered at about 500° F. for 3 hours. An alloy composition containing about 0.40% C, 0.84% Mn, 1.97% Si, 1.26% Cr, 3.78% Ni, 1.01% Mo, 0.56% Cu, 0.30% V, balance essentially Fe, has been found to provide a tensile strength in excess of 310 ksi in combination with a $K_k$ fracture toughness greater than 60 ksi √in, after being tempered at about 500° F. for 3 hours. Further, an alloy composition containing about 0.50% C, 0.69% Mn, 1.38% Si, 1.30% Cr, 3.99% Ni, 0.50% Mo, 0.55% Cu, 0.29% V, balance essentially Fe, has been found to provide a tensile strength in excess of 340 ksi in combination with a $K_{Ic}$ fracture toughness greater than 30 ksi √in, after being tempered at about 300° F. for 2½ hours plus 2½ hours.

No special melting techniques are needed to make the alloy according to this invention. The alloy is preferably vacuum induction melted (VIM) and, when desired as for critical applications, refined using vacuum arc remelting (VAR). It is believed that the alloy can also be arc melted in air. After air melting, the alloy is preferably refined by electroslag remelting (ESR) or VAR.

The alloy of this invention is preferably hot worked from a temperature of about 2100° F. to form various intermediate product forms such as billets and bars. The alloy is preferably heat treated by austenitizing at about 1585° F. to about 1635° F. for about 30 to 45 minutes. The alloy is then air cooled or oil quenched from the austenitizing temperature. The alloy is preferably deep chilled to either −100° F. or −320° F. for at least about one hour and then warmed in air. The alloy is preferably tempered at about 500° F. for about 3 hours and then air cooled. The alloy may be tempered at up to 600° F. when an optimum combination of strength and toughness is not required.

The alloy of the present invention is useful in a wide range of applications. The very high strength and good fracture toughness of the alloy makes it useful for machine tool components and also in structural components for aircraft, including landing gear. The alloy of this invention is also useful for automotive components including, but not limited to, structural members, drive shafts, springs, and crankshafts. It is believed that the alloy also has utility in armor plate, sheet, and bars.

WORKING EXAMPLES

Seven 35-1b. VIM heats were produced for evaluation. The weight percent compositions of the heats are set forth in Table 1 below. All heats were melted using ultra-clean raw materials and used calcium as a desulfurizing addition. The heats were cast as 4 in. square ingots. The ingots were forged to 2¼ in. square bars from a starting temperature of about 2100° F. The bars were cut to shorter lengths and half of the shorter length bars were further forged to 1 in. square bars, again from a starting temperature of 2100° F. The 1 in. bars were cut to still shorter lengths which were forged to ¾ in. square bars from 2100° F.

The ¾ in. square bars and the remainder of the 2¼ in. square bars were annealed at 1050° F. for 6 hours and then cooled in air to room temperature. Standard specimens for tensile testing and standard specimens for Charpy V-notch impact testing were prepared from the ¾ in. bars of each heat. Standard compact tension blocks for fracture toughness testing were prepared from the 2¼ in. square bars of each heat. All of the specimens were heat treated at 1585° F. for 30 minutes and then air cooled. The test specimens were then chilled at −100° F. for 1 hour and warmed in air to room temperature. Duplicate specimens of each heat were then tempered at one of three different temperatures, 400° F., 500° F., and 600° F., by holding at the respective temperature for 3 hours. The tempered specimens were then air cooled to room temperature.

TABLE I

| | 1509 | 1483 | 1484 | 1485 | 1486 | 1487 | 1488 |
|---|---|---|---|---|---|---|---|
| C | 0.36 | 0.35 | 0.37 | 0.36 | 0.37 | 0.41 | 0.44 |
| Mn | 0.83 | 0.83 | 0.83 | 0.84 | 0.84 | 0.84 | 0.83 |
| Si | 0.95 | 0.94 | 0.92 | 1.20 | 1.48 | 0.96 | 0.95 |
| P | <0.005 | <0.005 | <0.005 | <0.005 | <0.005 | <0.005 | <0.005 |
| S | <0.0005 | <0.0005 | <0.0005 | <0.0005 | <0.0005 | <0.0005 | <0.0005 |
| Cr | 1.26 | 1.28 | 1.25 | 1.25 | 1.26 | 1.26 | 1.26 |
| Ni | 3.76 | 3.78 | 3.76 | 3.78 | 3.77 | 3.75 | 3.78 |
| Mo | <0.01 | 0.20 | 0.49 | <0.01 | <0.01 | <0.01 | <0.01 |
| Cu | 0.55 | 0.55 | 0.54 | 0.55 | 0.55 | 0.55 | 0.55 |
| V | 0.30 | 0.29 | 0.29 | 0.29 | 0.30 | 0.29 | 0.30 |
| Ca | 0.0014 | 0.0013 | 0.002 | 0.0015 | 0.0014 | 0.0021 | 0.0017 |
| Fe | Bal.[1] | Bal.[1] | Bal.[1] | Bal.[1] | Bal.[1] | Bal.[1] | Bal.[1] |

[1]The balance includes usual impurities.

The results of mechanical, Charpy V-notch, and fracture toughness testing on the tempered specimens are presented in Table II below including the 0.2% Offset Yield Strength (Y.S.) and Ultimate Tensile Strength (U.T.S.) in ksi, the percent elongation (Elong.), the percent reduction in area (R.A.), the Charpy V-notch impact energy (CVN I.E.) in ft-lbs, and the $K_{Ic}$ fracture toughness ($K_{Ic}$) in ksi √in.

TABLE II

| Heat No. | Temper Temp. (F.) | Sample | Y.S. (ksi) | U.T.S. (ksi) | Elong. (%) | R.A. (%) | CVN I.E. (ft-lbs.) | KIc (ksi√in.) |
|---|---|---|---|---|---|---|---|---|
| 1509 | 400 | A1 | 232.6 | 277.5 | 11.5 | 46.1 | 24.5 | 92.2 |
| | | A2 | 226.9 | 269.8 | 12.8 | 51.8 | 25.4 | 92.7 |
| | | Avg. | 229.7 | 273.6 | 12.2 | 49.0 | 25.0 | 92.5 |
| | 500 | B1 | 235.4 | 275.9 | 10.9 | 51.3 | 24.3 | 90.1 |
| | | B2 | 235.3 | 275.4 | 10.9 | 50.2 | 23.2 | 94.3 |
| | | Avg. | 235.3 | 275.6 | 10.9 | 50.7 | 23.8 | 92.2 |
| | 600 | C1 | 234.4 | 269.1 | 10.9 | 50.8 | 20.6 | 89.0 |
| | | C2 | 235.1 | 269.9 | 10.9 | 50.8 | 21.8 | 84.7 |
| | | Avg. | 234.8 | 269.5 | 10.9 | 50.8 | 21.2 | 86.9 |
| 1483 | 400 | A1 | 230.1 | 277.2 | 12.2 | 50.1 | 25.7 | 99.4 |
| | | A2 | 234.2 | 280.9 | 12.4 | 50.2 | 25.5 | 99.9 |
| | | Avg. | 232.1 | 279.1 | 12.3 | 50.2 | 25.6 | 99.7 |
| | 500 | B1 | 236.8 | 276.1 | 11.5 | 50.8 | 21.3 | 95.8 |
| | | B2 | 239.4 | 277.9 | 10.5 | 46.2 | 21.6 | 93.9 |
| | | Avg. | 238.1 | 277.0 | 11.0 | 48.5 | 21.5 | 94.9 |
| | 600 | C1 | 240.1 | 272.3 | 11.9 | 52.8 | 19.4 | 90.4 |
| | | C2 | 240.6 | 273.4 | 11.0 | 51.2 | 18.8 | 90.9 |
| | | Avg. | 240.3 | 272.8 | 11.5 | 52.0 | 19.1 | 90.7 |
| 1484 | 400 | A1 | 234.9 | 279.9 | 12.1 | 50.1 | 22.7 | 96.9 |
| | | A2 | 235.8 | 280.4 | 11.7 | 49.0 | 23.5 | 97.9 |
| | | Avg. | 235.3 | 280.1 | 11.9 | 49.6 | 23.1 | 97.4 |
| | 500 | B1 | 239.4 | 278.4 | 11.2 | 50.6 | 21.9 | 96.8 |
| | | B2 | 241.2 | 280.5 | 10.9 | 47.2 | 22.7 | 94.8 |
| | | Avg. | 240.3 | 279.5 | 11.1 | 48.9 | 22.3 | 95.8 |
| | 600 | C1 | 243.4 | 277.1 | 11.1 | 50.5 | 18.6 | 91.2 |
| | | C2 | 239.6 | 272.8 | 10.6 | 48.9 | 17.9 | 91.4 |
| | | Avg. | 241.5 | 275.0 | 10.9 | 49.7 | 18.3 | 91.3 |

TABLE II-continued

| Heat No. | Temper Temp. (F.) | Sample | Y.S. (ksi) | U.T.S. (ksi) | Elong. (%) | R.A. (%) | CVN I.E. (ft-lbs.) | KIc (ksi√in.) |
|---|---|---|---|---|---|---|---|---|
| 1485 | 400 | A1 | 234.2 | 282.5 | 12.7 | 50.1 | 23.1 | 97.3 |
| | | A2 | 231.0 | 279.5 | 13.2 | 52.3 | 21.9 | 98.3 |
| | | Avg. | 232.6 | 281.0 | 13.0 | 51.2 | 22.5 | 97.8 |
| | 500 | B1 | 236.2 | 276.1 | 11.4 | 50.5 | 21.0 | 94.1 |
| | | B2 | 236.7 | 276.5 | 11.3 | 48.7 | 21.2 | 96.9 |
| | | Avg. | 236.4 | 276.3 | 11.4 | 49.6 | 21.1 | 95.5 |
| | 600 | C1 | 242.5 | 274.4 | 11.3 | 48.7 | 20.6 | 91.2 |
| | | C2 | 242.1 | 275.1 | 12.1 | 51.5 | 20.8 | 88.7 |
| | | Avg. | 242.3 | 274.8 | 11.7 | 50.1 | 20.7 | 90.0 |
| 1486 | 400 | A1 | 232.4 | 281.9 | 12.1 | 50.6 | 23.9 | 86.6 |
| | | A2 | 233.9 | 283.0 | 12.0 | 51.0 | 21.6 | 91.5 |
| | | Avg. | 233.2 | 282.4 | 12.1 | 50.8 | 22.8 | 89.1 |
| | 500 | B1 | 238.3 | 280.2 | 11.6 | 50.6 | 19.9 | 91.6 |
| | | B2 | 240.4 | 282.1 | 11.4 | 51.0 | 19.5 | 85.6 |
| | | Avg. | 239.3 | 281.1 | 11.5 | 50.8 | 19.7 | 88.6 |
| | 600 | C1 | 242.9 | 277.9 | 11.4 | 49.9 | 19.0 | 88.7 |
| | | C2 | 244.1 | 279.6 | 11.1 | 51.5 | 18.4 | 88.3 |
| | | Avg. | 243.5 | 278.7 | 11.3 | 50.7 | 18.7 | 88.5 |
| 1487 | 400 | A1 | 246.5 | 296.8 | 12.3 | 46.0 | 17.8 | 66.6 |
| | | A2 | 247.1 | 294.9 | 12.0 | 47.1 | 14.8 | 68.1 |
| | | Avg. | 246.8 | 295.9 | 12.2 | 46.6 | 16.3 | 67.4 |
| | 500 | B1 | 252.0 | 292.5 | 10.7 | 47.7 | 15.6 | 70.4 |
| | | B2 | 253.0 | 293.4 | 10.2 | 44.5 | 14.1 | 71.4 |
| | | Avg. | 252.5 | 293.0 | 10.5 | 46.1 | 14.9 | 70.9 |
| | 600 | C1 | 251.6 | 285.6 | 10.1 | 46.5 | 16.2 | 68.8 |
| | | C2 | 252.4 | 284.7 | 10.8 | 47.1 | 15.2 | 64.7 |
| | | Avg. | 252.0 | 285.1 | 10.5 | 46.8 | 15.7 | 66.8 |
| 1488 | 400 | A1 | 253.2 | 305.2 | 10.9 | 42.4 | 14.8 | 52.6 |
| | | A2 | 254.9 | 306.8 | 10.9 | 42.3 | 15.3 | 59.5 |
| | | Avg. | 254.1 | 306.0 | 10.9 | 42.4 | 15.1 | 56.1 |
| | 500 | B1 | 262.3 | 304.1 | 9.7 | 44.6 | 15.4 | 54.3 |
| | | B2 | 262.2 | 304.7 | 9.7 | 43.4 | 14.9 | 57.6 |
| | | Avg. | 262.3 | 304.4 | 9.7 | 44.0 | 15.2 | 56.0 |
| | 600 | C1 | 259.8 | 295.7 | 10.0 | 44.8 | 14.8 | 50.1 |
| | | C2 | 261.6 | 297.5 | 10.0 | 44.7 | 14.5 | 49.8 |
| | | Avg. | 260.7 | 296.6 | 10.0 | 44.8 | 14.7 | 50.0 |

The data presented in Table II show that Heat 1484, which has a weight percent composition in accordance with the alloy described herein, is the only alloy composition that provides a tensile strength of 280 ksi and a fracture toughness of at least 90 ksi √in after tempering a 500° F.

The terms and expressions which are employed herein are used as terms of description and not of limitation. There is no intention in the use of such terms and expressions of excluding any equivalents of the features shown and described or portions thereof. It is recognized that various modifications are possible within the invention described and claimed herein.

The invention claimed is:

1. A steel alloy consisting essentially of, in weight percent, about:

| | |
|---|---|
| Carbon | 0.35-0.55 |
| Manganese | 0.7-1.2 |
| Silicon | 0.9-2.1 |
| Phosphorus | 0.01 max. |
| Sulfur | 0.001 max. |
| Chromium | 1.0-1.5 |
| Nickel | 3.5-4.5 |
| Molybdenum | 0.4-1.1 |
| Copper | 0.5-0.6 |
| Cobalt | 0.01 max. |
| Vanadium | 0.25-0.35 |
| Titanium | 0.01 max. |
| Calcium | up to 0.005 |

the balance being iron and usual impurities.

2. The alloy claimed in claim 1 which contains at least 0.37% carbon.

3. The alloy claimed in claim 1 which contains not more than 4.2% nickel.

4. The steel alloy claimed in claim 1 wherein the alloy contains not more than about 0.005% phosphorus and not more than about 0.0005% sulfur.

5. A quenched and tempered steel article formed from the alloy claimed in claim 1, said article providing a tensile strength of at least 280 ksi and a $K_{Ic}$ fracture toughness of at least 90 ksi √in after having been tempered at a temperature of 500° F.

6. The quenched and tempered article claimed in claim 5 wherein the article is a structural component of an aircraft.

7. The quenched and tempered article claimed in claim 6 wherein the article is a landing gear component.

8. The alloy claimed in claim 1 which contains not more than 0.45% carbon.

9. The alloy claimed in claim 1 which contains at least 0.8% manganese.

10. A steel alloy consisting essentially of, in weight percent, about:

| | |
|---|---|
| Carbon | 0.37-0.55 |
| Manganese | 0.8-1.2 |
| Silicon | 0.9-2.1 |
| Phosphorus | 0.01 max. |
| Sulfur | 0.001 max. |
| Chromium | 1.0-1.5 |
| Nickel | 3.5-4.2 |

-continued

| | |
|---|---|
| Molybdenum | 0.4-1.1 |
| Copper | 0.5-0.6 |
| Cobalt | 0.01 max. |
| Vanadium | 0.25-0.35 |
| Titanium | 0.01 max. |
| Calcium | up to 0.005 |

the balance being iron and usual impurities.

* * * * *